US006034340A

United States Patent [19]

Aoki et al.

[11] Patent Number: 6,034,340

[45] Date of Patent: Mar. 7, 2000

[54] SWITCH ASSEMBLY

[75] Inventors: Yoshiyuki Aoki; Kazuyoshi Ishiguro, both of Niwa-gun, Japan

[73] Assignee: Kabushiki Kaisha Tokai-Rika-Denki-Seisakusho, Aichi, Japan

[21] Appl. No.: 09/288,241

[22] Filed: Apr. 8, 1999

[30] Foreign Application Priority Data

Apr. 15, 1998 [JP] Japan ..... 10-104297

[51] Int. Cl.[7] ..... H01H 3/12

[52] U.S. Cl. ..... 200/345; 200/517; 200/314

[58] Field of Search ..... 200/5 A, 310, 200/314, 512–517, 341–345; 400/490, 491, 491.2, 495, 495.1

[56] References Cited

U.S. PATENT DOCUMENTS

| | | | |
|---|---|---|---|
| 4,139,756 | 2/1979 | Tsen et al. | 200/330 |
| 4,190,748 | 2/1980 | Langford | 200/5 A |
| 4,341,934 | 7/1982 | Muller | 200/159 A |
| 4,582,967 | 4/1986 | Brumit et al. | 200/5 A |
| 5,280,146 | 1/1994 | Inagaki et al. | 200/341 |
| 5,430,263 | 7/1995 | English et al. | 200/5 A |
| 5,536,543 | 7/1996 | Papandreou | 428/35.7 |

FOREIGN PATENT DOCUMENTS

| | | | |
|---|---|---|---|
| 6-41039 | 5/1994 | Japan | H01H 21/00 |

*Primary Examiner*—Michael Friedhofer
*Attorney, Agent, or Firm*—Oliff & Berridge, PLC

[57] ABSTRACT

Upon depression of a depression surface of an operating knob of a switch assembly, a depression working surface pushes down the head portion of a rubber contact, and a switching operation is performed. The operating knob is pushed up by the return elastic force of the rubber contact and returned to its original position. Then the upper face of the depression portion abuts against the correction member. As the correction member is positioned directly above the rubber contact, the moment generated by the return elastic force of the rubber contact is offset and the operating knob is straightened and maintained to be in a horizontal position. Therefore, the side surfaces of the head portion projecting from the operation hole of the switch case barely rub against the side edges of the operation hole in a depressed state owing to inclination of the operating knob.

9 Claims, 3 Drawing Sheets

SWITCH ASSEMBLY

The disclosure of Japanese Patent Application No. HEI 10-104297 filed on Apr. 15, 1998 including the specification, drawings and abstract is incorporated herein by reference in its entirety.

BACKGROUND OF THE INVENTION

1. Field of the Invention

The present invention relates to a switch assembly having an operating knob with a depression surface projecting from a switch case, in which a return elastic force acts upon one edge of a depression working surface on the lower face of the operating knob except the center portion thereof.

2. Description of the Related Art

Fitting an illuminating lamp or a beacon lens within the aforementioned operating knob causes the return elastic force of a return spring, rubber contact of a push momentary type and so forth to act upon one edge of a depression working surface on the lower face of the operating knob except the center portion thereof. With the aforementioned switch assembly in a non-depressed state, the moment generated by the return elastic force and the deadweight of the operating knob inclines the operating knob within the switch case.

As is shown in FIG. 4 rather exaggeratedly, if depression is performed in a state where the operating knob 20 has been inclined within the switch case 22 in a non-depressed state, an upper angle portion 21 of the operating knob 20 is brought into abutment against a ceiling surface 23 of the switch case 22, or side surfaces of a head portion 25 of the operating knob 20 projecting from an operation hole 24 of the switch case 22 get rubbed against side edges of the operation hole 24, interfering with the smooth depression.

SUMMARY OF THE INVENTION

In conjunction with the foregoing problem of the generally employed art, it is an object of the present invention to provide a switch assembly that allows smooth depression by straightening the operating knob.

According to the first aspect of the invention, there is a switch assembly including an operating knob with a depression surface projecting from a switch case, return elastic force generating means for causing a return elastic force to act upon a depression working surface on the lower face of the operating knob except the center thereof, and a correction member for straightening and maintaining an upright position of the operating knob, which is brought into abutment against the operating knob to generate a moment in a direction reverse to the moment generated by the return elastic force acting upon the operating knob.

In the switch assembly, the correction member abuts against the operating knob that has been returned by the return elastic force. The correction member generates the moment in a direction reverse to the moment generated by the return elastic force. Accordingly such moment offsets the moment generated by the return elastic force as well as straightens and maintains the upright position of the operating knob. Therefore the side surfaces of the operating knob projecting from the operation hole of the switch case do not rub against the side edges of the operation hole, thus allowing smooth depression.

The correction member of the first aspect of the invention may be abutted against the operating knob at a position upward of the return elastic force generating means such that the distance between the correction member and the center of gravity of the operating knob is equal to or greater than the distance between the return elastic generating means and center of gravity of the operating knob.

According to the first aspect of the invention, the return elastic force generation means may be a rubber contact of push momentary type or a return spring.

The correction member can be formed to vertically extend downward from the switch case to be directly above the position upon which the return elastic force acts. The switch case may have an operation hole through which the depression surface of the operating knob projects.

The operating knob is formed so that the center portion is hollow, to which at least either an illumination lamp or a beacon lens is fitted.

The aforementioned correction member is able to straighten and maintain the operation knob to be in a horizontal position within the switch case.

A switch assembly of a second aspect of the present invention includes an operating knob with a depression surface projecting from a switch case and return elastic force generating means for causing a return elastic force to act upon a depression working surface on the lower face of the operating knob except the center portion thereof, and the operating knob has an abutment portion that abuts against the switch case so as to generate the moment in a direction reverse to that of the moment generated in the operating knob by the return elastic force.

DETAILED DESCRIPTION OF THE PREFERRED EMBODIMENTS

An embodiment of the present invention will be described with reference to the accompanying drawing.

Figure 1:
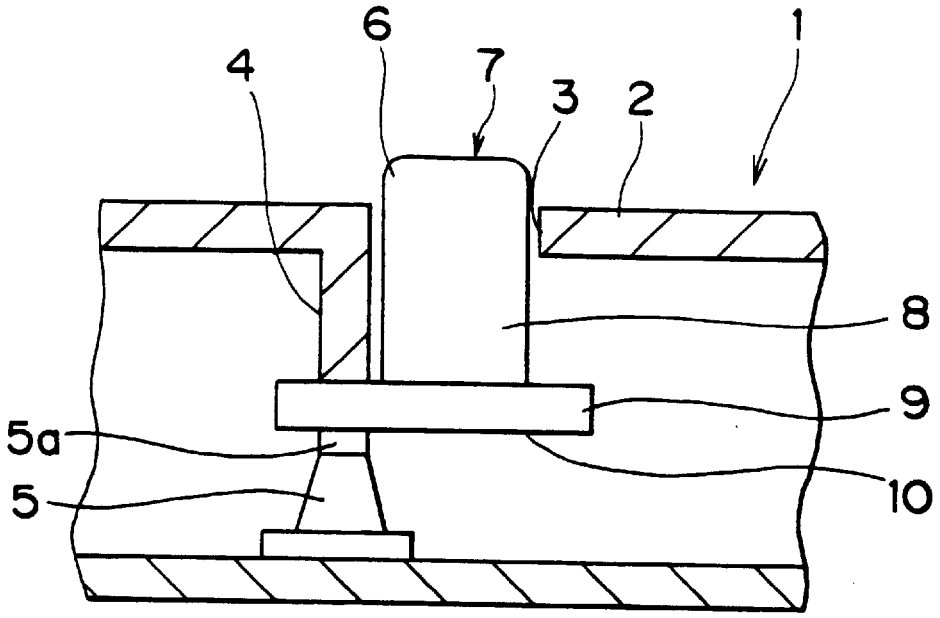
FIG. 1 is a schematic sectional view showing a switch assembly of an embodiment of the present invention.

FIG. 1 is a schematic sectional view of a switch assembly 1 of the present invention in a non-depressed state. An operation hole 3 is formed in the upper surface of a switch case 2. One side edge of the operation hole 3 vertically extends downward to form a correction member 4. A rubber contact 5 of a push momentary type is positioned directly below the correction member 4.

Figure 1A:
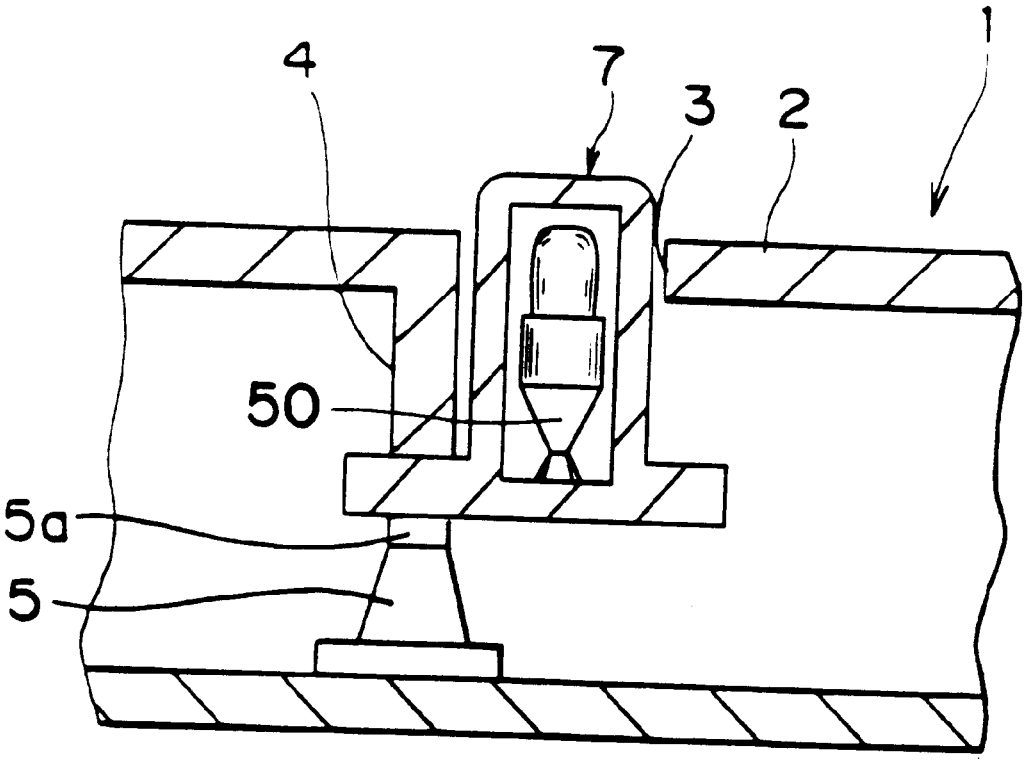
FIG. 1A is a partial cross-sectional view of the switch assembly of FIG. 1 showing an illuminating lamp contained within a hollow of the operating knob.

An operating knob 6 is formed of a head portion 8 having a depression surface 7 on the upper face and a depression portion 9 integrally attached to the lower face of the head portion 8. A depression working surface 10 is formed at one side of the lower face of the depression portion 9 (in FIG. 1, the left side of the lower face of the depression portion 9). Both the center portions of the head portion 8 and the depression portion 9 are hollow, as shown in FIG. 1A, to accommodate the illuminating lamp (50) or the beacon lens (not shown).

The operating knob 6 is fitted in the operation hole 3 such that the head portion 8 projecting from the operation hole 3 formed in the switch case 2. The lower end of the correction member 4 formed in the switch case 2 abuts against the upper surface of the depression portion 9. Meanwhile a head portion 5*a* of the rubber contact 5 abuts against the depression working surface 10 on the lower face of the depression portion 9. Each size of the correction member 4 and the rubber contact 5, especially the vertical length thereof is set such that the correction member 4 abuts against the upper face of the depression portion 9 and the rubber contact 5 abuts against the lower face of the depression portion 9 to prevent gaps therebetween respectively in a non-depressed state.

With the aforementioned switch assembly 1, when the depression surface 7 of the operating knob 6 is depressed, the depression working surface 10 pushes down the head portion 5*a* of the rubber contact 5, and switching is performed. Conversely, when depression is released, the operating knob 6 is pushed up by the return elastic force of the rubber contact 5 and returned to its original position (as shown in FIG. 1). Then the upper face of the depression portion 9 abuts against the correction member 4.

As the correction member 4 is positioned directly above the rubber contact 5, the moment generated by the return elastic force of the rubber contact 5 is offset by the moment generated by abutment of the correction member 4 against the upper surface of the depression portion 9, thus maintaining the operating knob 6 in a horizontal position. Therefore the operating knob 6 is kept from inclining within the switch case 2 in a non-depressed state. When depression is performed, the side edges of the operation hole 3 barely rub against the side surfaces of the head portion 8 projecting from the operation hole 3 formed in the switch case 2. As a result, smooth depression can be realized.

The aforementioned embodiment uses the rubber contact 5 of a push momentary type as a structure for generating the return elastic force. However, other types of a known elastic member can be employed. For example, the switch assembly may employ a return spring attached to the depression working surface 10.

Figure 2:
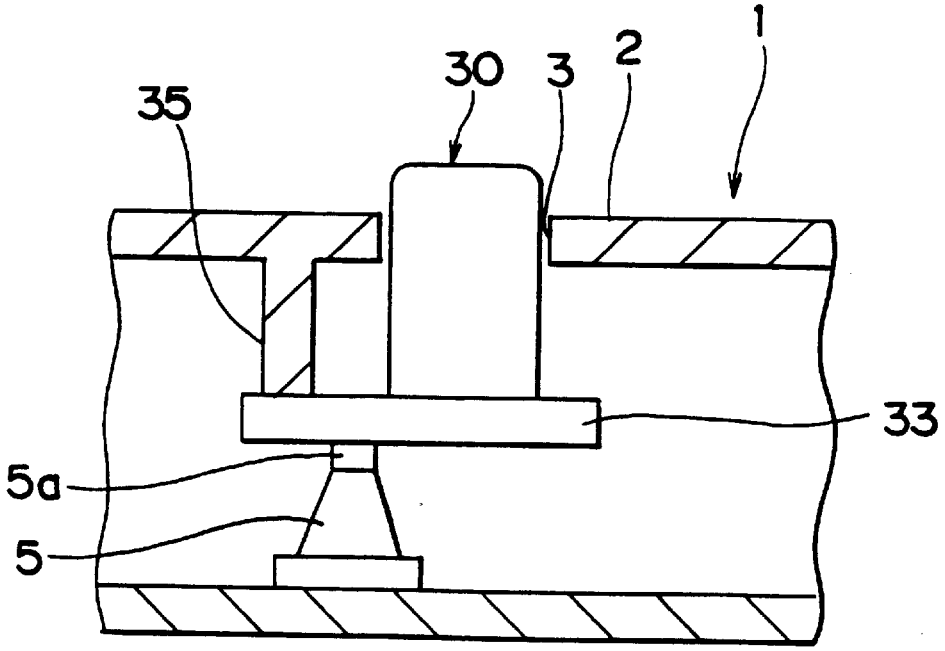
FIG. 2 is a sectional view showing a switch assembly of the other embodiment of the present invention.

In the aforementioned embodiment, the correction member 4 vertically extends downward directly above the rubber contact 5. The correction member, however, is not limited to the foregoing member as long as it is capable of providing enough force to generate the moment that can offset the moment generated by the return elastic force and the deadweight of the operating knob, i.e., the moment in a direction reverse thereto. Therefore, the position where the correction member abuts against the depression portion of the operating knob is not limited to the position directly above the rubber contact 5. It may be arbitrarily specified as long as it is positioned at the same side where the rubber contact 5 is positioned with respect to the operating knob 6, and its distance from the center of gravity of the operating knob 6 is at the side farther than the position where the return elastic force acts thereon. For example, as is shown in FIG. 2, it can be structured such that the position where the correction member 35 abuts against the depression portion 33 of the operating knob 30 may be at the left side from the rubber contact 5. If the foregoing conditions are satisfied, the correction member 35 does not have to extend vertically downward. Instead, the correction member 35 may be formed to diagonally abut against the depression portion of the operating knob.

Figure 3:
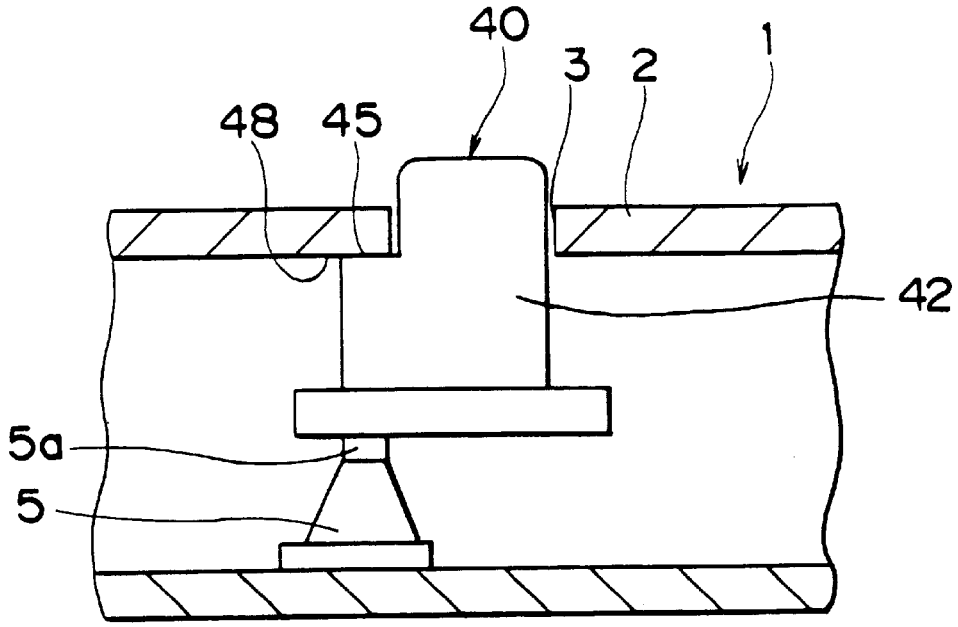
FIG. 3 is a sectional view showing a switch assembly of yet the other embodiment of the present invention.
Figure 4:
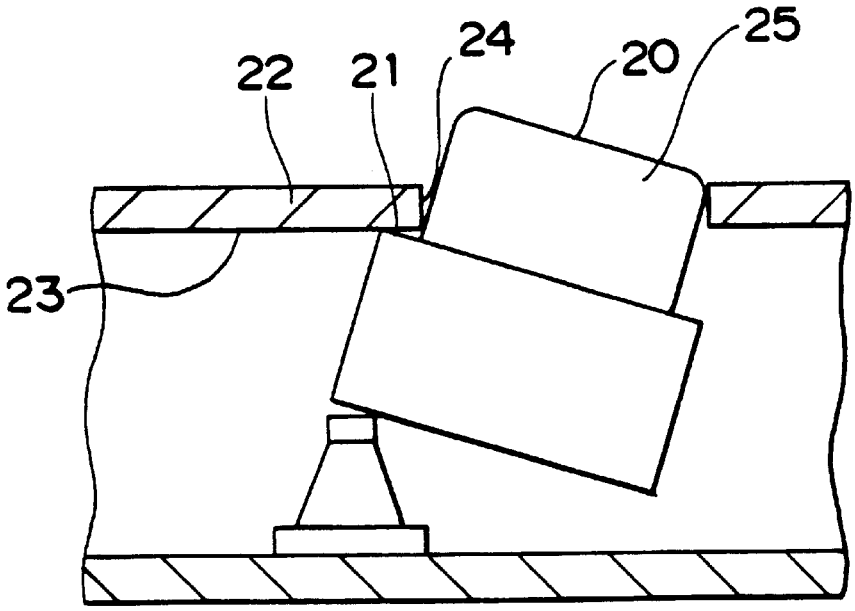
FIG. 4 RELATED ART
FIG. 4 is a schematic sectional view of a general switch assembly.

In the aforementioned embodiment, the moment in a direction reverse to that of the moment generated by the return elastic force and the deadweight of the operating knob is generated by bringing the correction member into abutment against the depression portion of the operating knob. Additionally, the present invention makes it possible to generate the moment in a direction reverse to that of the moment generated by the return elastic force and the deadweight of the operating knob by bringing the operating knob into partial abutment against the side edge of the operation hole. As is shown in FIG. 3, a stepped portion 45 is formed on the head portion 42 of the operating knob 40 upward of the rubber contact 5. The upper face of the stepped portion 45 abuts against the lower face 48 of the side edge of the operation hole 3. Like the aforementioned embodiment, the above structure allows the moment generated by the force for abutting the upper face of the stepped portion 54 against the lower face 48 of the side edge of the operation hole 3 to offset the moment generated by the return elastic force of the rubber contact 5. As a result, the upright state of the operating knob 40 can be corrected and maintained in a horizontal position.

What is claimed is:

1. A switch assembly comprising:

a switch case having an upper planar wall with an operation hole formed therein;

an operating knob having a depression surface that projects though the operation hole;

return elastic force generating means for causing a return elastic force to act upon a depression working surface on a lower face of said operating knob except at a center portion thereof; and a correction member for straightening and maintaining a horizontal position of said operating knob within said switch case, which is brought into abutment against said operating knob to generate a moment in a direction reverse to that of a moment generated in said operating knob by said return elastic force, wherein the correction member is formed to vertically extend downward from an edge of said switch case forming said operation hole.

2. The switch assembly according to claim 1, wherein said correction member abuts against said operating knob at a position upward of said return elastic force generating means where a distance between said correction member and a center of gravity of said operating knob is equal to or greater than a distance between said return elastic force generating means and a center of gravity of said operating knob.

3. The switch assembly according to claim 1, wherein said return elastic force generating means is a rubber contact of a push momentary type.

4. The switch assembly according to claim 1, wherein said return elastic force generating means is a return spring.

5. The switch assembly according to claim 1, wherein said correction member is directly above a position where said return elastic force acts thereupon.

6. The switch assembly according to claim 1, wherein a center portion of said operating knob is hollow.

7. The switch assembly according to claim 1, wherein a center portion of said operating knob accommodates at least one illuminating lamp or one beacon lens.

8. A switch assembly comprising:

a switch case having an upper planar wall with an operation hole formed therein;

an operating knob having a depression surface that projects though the operation hole; and return elastic force generating means for causing a return elastic force to act upon a depression working surface on a lower face of said operating knob except at a center portion thereof; wherein said operating knob has an abutment portion that abuts against said switch case so as to generate a moment in a direction reverse to that of a moment generated in said operating knob by said return elastic force, wherein said abutment portion is a stepped portion formed in the depression surface of said operating knob at a position opposing an edge of said operation hole so that said stepped portion engages a lower surface of said upper planar wall of said switch case to straighten and maintain the operating knob in a horizontal position within said switch case.

9. A switch assembly comprising:

a switch case having an upper planar wall with an operation hole formed therein;

an operating knob having a depression surface that projects though the operation hole;

return elastic force generating means for causing a return elastic force to act upon a depression working surface on a lower face of said operating knob except at a center portion thereof; and a correction member for straightening and maintaining a horizontal position of said operating knob within said switch case, which is brought into abutment against said operating knob to generate a moment in a direction reverse to that of a moment generated in said operating knob by said return elastic force, wherein the correction member is formed to vertically extend downward from said upper planar wall of said switch case at a position adjacent to an edge of said switch case forming said operation hole, the correction member forming a "T" with said upper planar wall of said switch case.

* * * * *